US009945192B2

(12) United States Patent
Brice et al.

(10) Patent No.: US 9,945,192 B2
(45) Date of Patent: Apr. 17, 2018

(54) HYDRAULIC DRAW WORKS

(71) Applicants: Wiley T. Brice, Lafayette, LA (US); David J. Harris, Cheddar (GB); Graham A. Hamshaw, Cheddar (GB)

(72) Inventors: Wiley T. Brice, Lafayette, LA (US); David J. Harris, Cheddar (GB); Graham A. Hamshaw, Cheddar (GB)

(73) Assignee: Viola Group Limited (GB)

( * ) Notice: Subject to any disclaimer, the term of this patent is extended or adjusted under 35 U.S.C. 154(b) by 352 days.

(21) Appl. No.: 14/705,779

(22) Filed: May 6, 2015

(65) Prior Publication Data

US 2016/0032666 A1 Feb. 4, 2016

Related U.S. Application Data

(60) Provisional application No. 61/989,393, filed on May 6, 2014.

(51) Int. Cl.
*E21B 19/086* (2006.01)

(52) U.S. Cl.
CPC ..... *E21B 19/086* (2013.01)

(58) Field of Classification Search
CPC ..... E21B 19/086
See application file for complete search history.

(56) References Cited

U.S. PATENT DOCUMENTS 1,790,913 A 6/1928 Grau et al.
2,502,895 A 4/1950 Shaffer
2,821,264 A 1/1958 Ulinski
2,904,310 A 9/1959 Leonard
3,780,816 A * 12/1973 Arrington ..... E21B 7/027 173/152
3,986,564 A 10/1976 Bender
4,336,840 A 6/1982 Bailey
4,456,077 A * 6/1984 Lagerstedt ..... E21B 19/084 173/147
4,610,139 A 9/1986 Skelly
4,703,812 A 11/1987 Johnson
(Continued)

FOREIGN PATENT DOCUMENTS

GB WO1990/012948 11/1990

OTHER PUBLICATIONS

"Exploration With High-Tech: Deep Drilling Rig Terra Invader 350/450 Box-On-Box" (Brochure from Herrenknecht Vertical GmbH).

(Continued)

*Primary Examiner* — Brad Harcourt

(57) ABSTRACT

A hydraulic draw-works comprises several hydraulic cylinders of mixed orientation, such that some hydraulic cylinders actuate upwards and some hydraulic cylinders actuate downwards. These cylinders are connected by a plurality of braces mounted along a guide rail, and the drill head is mounted on a carriage along the guide rail and actuated by the upwards-oriented cylinders. The use of mixed orientation cylinders allows the effective vertical stroke length required to raise and lower the drill head to be halved. In a preferred embodiment, through-rod porting of the downwards-oriented cylinders supplies hydraulic fluid to the remainder through a manifold, and digitally controlled directional valves allow precise control of the drill head.

19 Claims, 10 Drawing Sheets

(56) References Cited

U.S. PATENT DOCUMENTS

| | | | | |
|---|---|---|---|---|
| 5,941,324 | A * | 8/1999 | Bennett | E21B 19/14 166/77.51 |
| 6,068,066 | A | 5/2000 | Byrt et al. | |
| 6,343,662 | B2 | 2/2002 | Byrt et al. | |
| 6,659,200 | B1 * | 12/2003 | Eppink | E21B 4/18 166/381 |
| 8,453,762 | B2 | 6/2013 | Law et al. | |
| 2012/0061144 | A1 | 3/2012 | Strange | |

OTHER PUBLICATIONS

"New Technology Drilling Rig"; article by Jurgen Binder; Proceedings European Geothermal Congress, Unterhaching, Germany, May 30 to Jun. 1, 2007.

* cited by examiner

HYDRAULIC DRAW WORKS

FIELD

The present disclosure relates to a hydraulic draw works, and in particular, but without limitation, to a hydraulic cylinder assembly and method for vertically lifting and lowering along the length of a mast a drill head or other tools usable during downhole operations.

BACKGROUND

In the oil and gas industry, and water well industry, a draw works is an apparatus by which a drill head or a top drive is raised and lowered along a vertically positioned derrick or mast to facilitate downward, vertical, and/or lateral drilling. Such drilling can be achieved by utilizing oil country tubular goods (OCTG) or tubulars and all related tooling, instruments and mechanical devices that are driven by the draw works, in a downward vertical direction to bore a hole. Thereafter, the tubular can be detached and the drill head can be moved upward to receive another tubular for connection to the previous tubular and downward movement into the well bore for continued vertical and/or lateral drilling.

Furthermore, the draw works can be used to remove tubulars and related tooling, instruments, and mechanical devices from the bore hole. During the removal process, the draw works lifts and withdraws the uppermost tubular of a tubular string, allowing the tubular to be detached. Once detached, the draw works can lower the tubular where it can be removed for storage. Lastly, the draw works can be attached to the next uppermost tubular extending from the bore hole and lifted to withdraw a subsequent section of the tubular string from the bore hole.

Draw works is a required apparatus for the vertical and/or lateral drilling and must be able to lift and position tubulars vertically above the bore hole. The hydraulic draw works of the present disclosure can replace prior draw works, which may contain rack and pinion devices, cable devices, combined cable and hydraulic devices, wire line winches with stationary sheave, or travelling sheave and wire line assemblies

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Generally, the present disclosure relates to a hydraulic draw works, and in particular, but without limitation, to a hydraulic cylinder assembly for lifting and lowering a carriage along the length of a mast. The hydraulic draw works can be fully automated by pressurized fluid, namely hydraulic fluid, to achieve velocities and stroke length (i.e., speed and length of extension) to facilitate lifting and lowering actions of a drill head, or other tools, to suit oil field or gas drilling or water well applications on land or sea.

Figure 1:
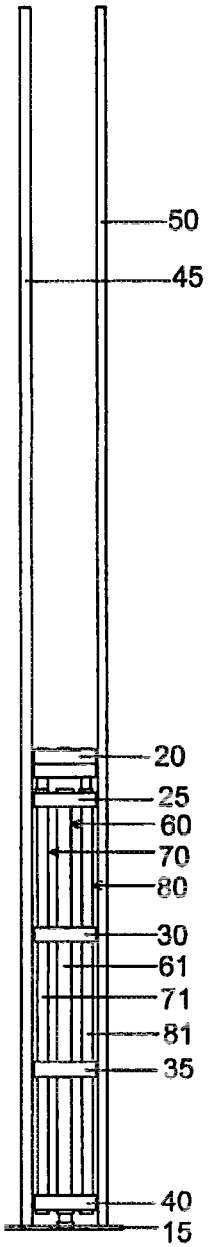
FIG. 1 depicts a front elevational view of an embodiment of a hydraulic draw works in accordance with the present disclosure, with the hydraulic cylinders in a fully retracted position.
Figure 2:
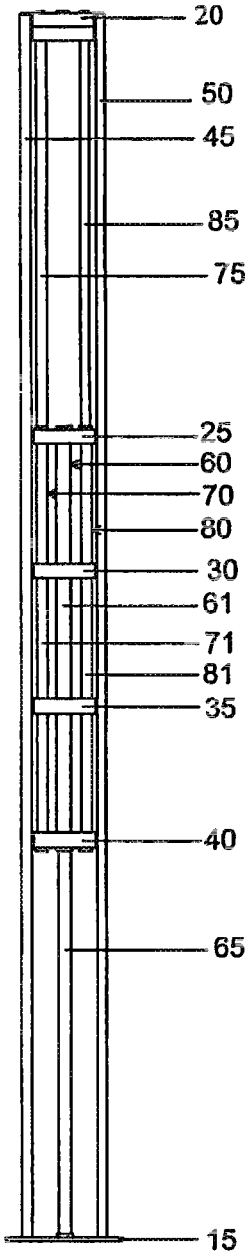
FIG. 2 depicts a front elevational view of an embodiment of a hydraulic draw works in accordance with the present disclosure, with the hydraulic cylinders in a fully extended position.

Referring now to FIGS. 1 and 2, depicting a front elevational view of a hydraulic draw works (10) in accordance with the present disclosure. FIG. 1 depicts the hydraulic draw works (10) in its lowermost or fully retracted position, while FIG. 2 depicts the hydraulic draw works (10) in its uppermost or fully extended position. The hydraulic draw works (10) is shown comprising a hydraulic cylinder assembly, which includes three hydraulic cylinders (60, 70, 80) fixedly connected to each other by four braces (25, 30, 35, 40). Each cylinder (60, 70, 80) can comprise a tubular body (61, 71, 81), a piston (62, 72, 82, see FIGS. 11 and 12) slidably positioned within the body (61, 71, 81), and a rod (65, 75, 85) fixedly connected to the piston and extending from one end of the tubular body (61, 71, 81). As the rod (65, 75, 85) is fixedly connected to the slidable piston, the rod (65, 75, 85) can move into and out of the tubular body (61, 71, 81).

As further shown in FIGS. 1 and 2, the first or central cylinder (60) is shown oriented with its rod (65) extending in the downward direction, while the second and third cylinders (70, 80), also referred to as the outer cylinders, are shown oriented with their rods (75, 85) extending in the upward direction. The four braces (25, 30, 35, 40), which hold the tubular bodies (61, 71, 81) of the cylinders (60, 70, 80) together, are depicted as rectangular blocks. In an embodiment of the hydraulic draw works (10), the braces (25, 30, 35, 40) can have three apertures extending laterally therethrough to accommodate the tubular bodies (61, 71, 81) therein. The tubular bodies (61, 71, 81) can be retained within the braces (25, 30, 35, 40) by way of friction or interference fit between the cylinder bodies (61, 71, 81) and the braces (25, 30, 35, 40). In another embodiment (not shown) of the hydraulic draw works (10), the braces (25, 30, 35, 40) can be bolted or welded to the tubular bodies (61, 71, 81) to prevent relative motion therebetween.

The first or the outer end of the rod (65) of the first cylinder (60), is shown attached to the base (15) of the hydraulic draw works (10). The base (15), depicted as a generally flat plate, can be connected to a bottom portion of a mast assembly (not shown) and/or to a floor of a rig structure (not shown). Alternatively, the rod (65) of the first cylinder (60) can be connected directly to the rig structure. The first or the outer ends of the rods (75, 85) of the second and third cylinders (70, 80), are shown attached to a carriage (20). The carriage (20), depicted as rectangular block, can be adapted for connection with a drill head (i.e., a top drive) (see FIG. 5), or other tools to be lifted during drilling and other downhole operations.

Although the hydraulic draw works (10) depicted in FIGS. 1 and 2 is shown comprising one cylinder (60) with its rod (65) connected to the base (15), and two cylinders (70, 80) with their rods (75, 85) connected to the carriage (20), other embodiments (not shown) of the hydraulic draw works can comprise two cylinders with their rods connected to the base (15) and/or one cylinder with its rod connected to the carriage (20).

Figure 3:
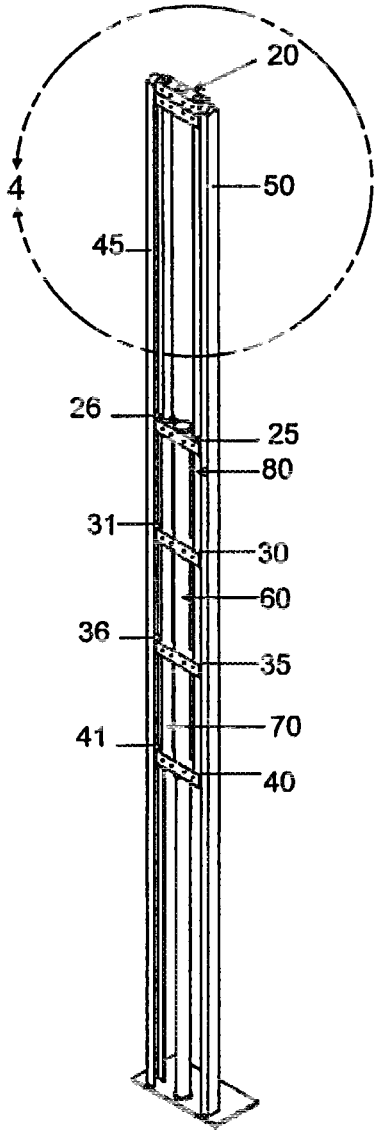
FIG. 3 depicts an isometric view of an embodiment of a hydraulic draw works in accordance with the present disclosure, with the hydraulic cylinders in a fully extended position.
Figure 4:
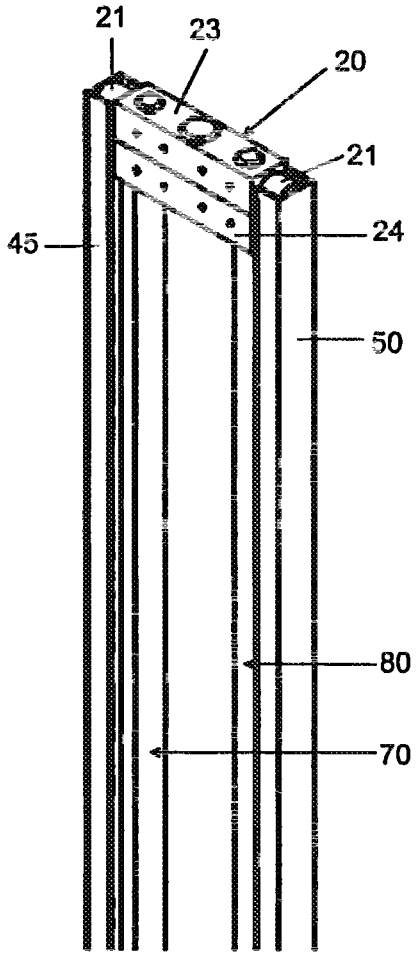
FIG. 4 depicts a close-up isometric view of an upper portion of the hydraulic draw works depicted in FIG. 3.

Furthermore, the carriage (20) and the braces (25, 30, 35, 40) are usable to stabilize and guide the movement of the cylinders (60, 70, 80) during lifting and lowering operations of the hydraulic draw works (10). Specifically, the hydraulic draw works (10) can further comprise two vertical guides depicted as guide beams (45, 50) usable to stabilize and guide the movement of the carriage (20) and braces (25, 30, 35, 40), thereby stabilizing and guiding the movement of the cylinders (60, 70, 80) during lifting and lowering operations. Referring now to FIGS. 3 and 4, depicting isometric and close-up isometric views of an embodiment of the hydraulic draw works (10). The Figures show the guide beams (45, 50) as channel beams (i.e., C-beams), which receive a portion of the carriage (20) and the braces (25, 30, 35, 40) within the channel portion of the guide beams (45, 50). Although the vertical guides are depicted as channel beam, in other embodiments (not shown) of the hydraulic draw works (10), the vertical guides can comprise an I-beam or a rail that can be positioned between two or more projections extending from the carriage (20) and/or the braces (25, 30, 35, 40) to control the position and guide the motion of the carriage (20) and/or the braces (25, 30, 35, 40).

Figure 9:
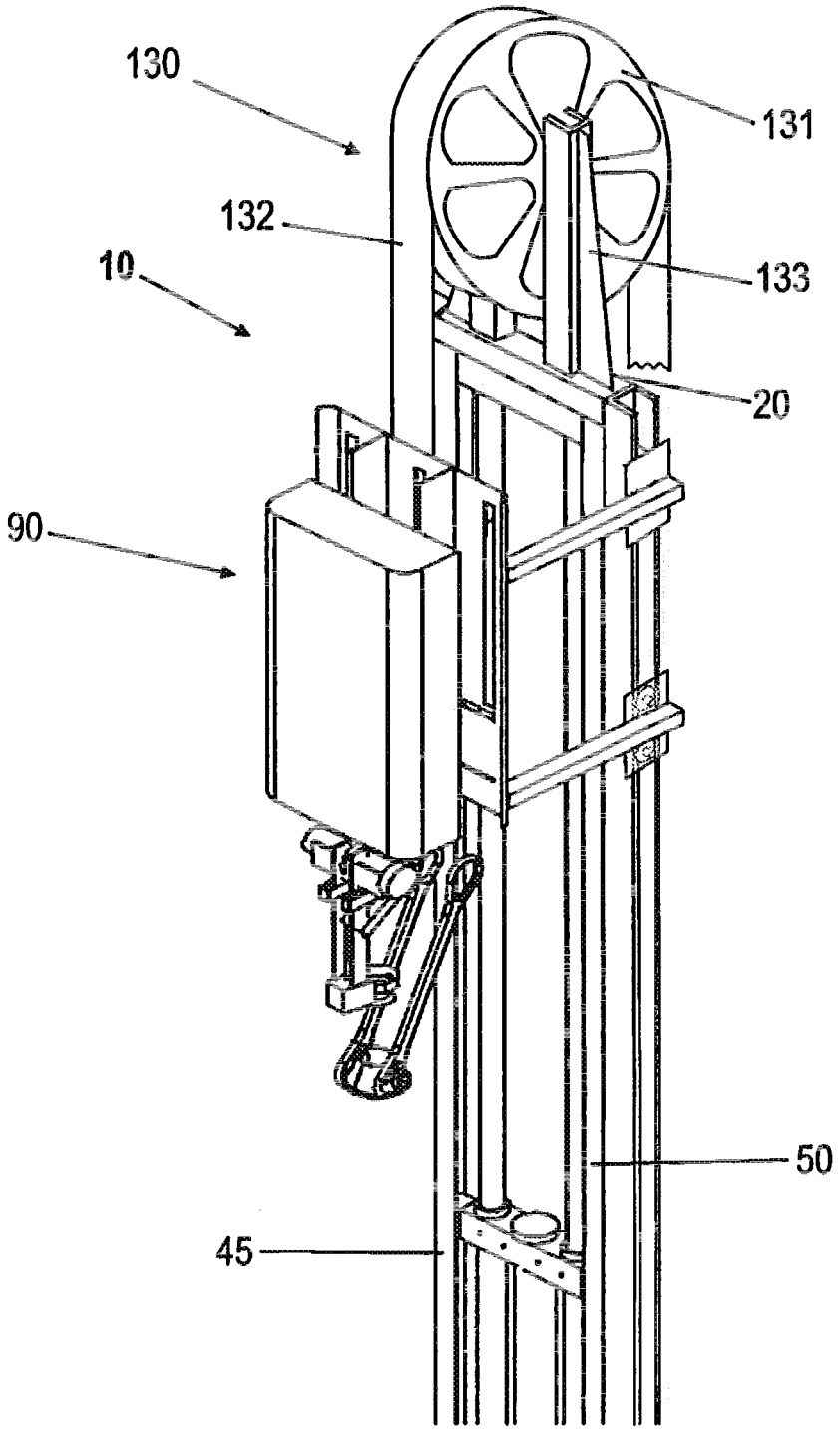
FIG. 9 depicts an close-up isometric view of an upper portion of another embodiment of the hydraulic draw works and the drill head in accordance with the present disclosure.

Specifically, the carriage (20) can further comprise guide wheels (21), which can be positioned within the channel of the guide beams (45, 50) to maintain the carriage (20) between the guide beams (45, 50), as the cylinders (60, 70, 80) extend and retract during lifting and lowering operations. FIG. 3 also depicts the braces (25, 30, 35, 40) having wheels (26, 31, 36, 41) extending laterally therefrom, wherein the wheels maintain the braces between the guide beams (45, 50), as the cylinders (60, 70, 80) extend and retract. The hydraulic draw works (10) can be incorporated into a pre-existing mast or derrick (not shown), wherein the guide beams (45, 50) are positioned over or adjacent to the well bore and fixedly connected to the structure of the mast or derrick. Furthermore, the hydraulic draw works (10) can be incorporated into the mast or derrick prior to erection or construction of the mast or derrick at the well site, wherein the guide beams (45, 50) and the cylinders (60, 70, 80) can be fabricated as part of the mast or derrick. As depicted in FIG. 9, the guide beams can comprise multiple portions, which can be transported at the well site and assembled.

Figure 5:
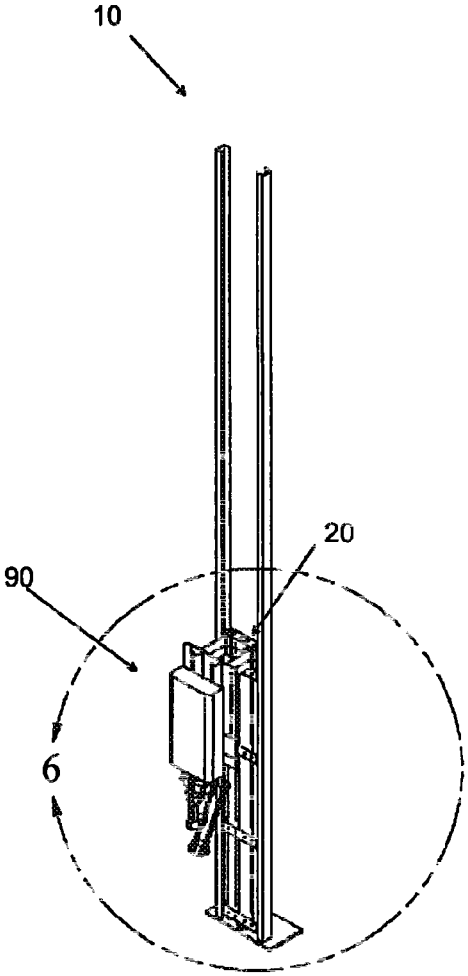
FIG. 5 depicts an isometric view of an embodiment of a hydraulic draw works in accordance with the present disclosure, with the hydraulic cylinders in a fully retracted position and the drill head near the base.
Figure 6:
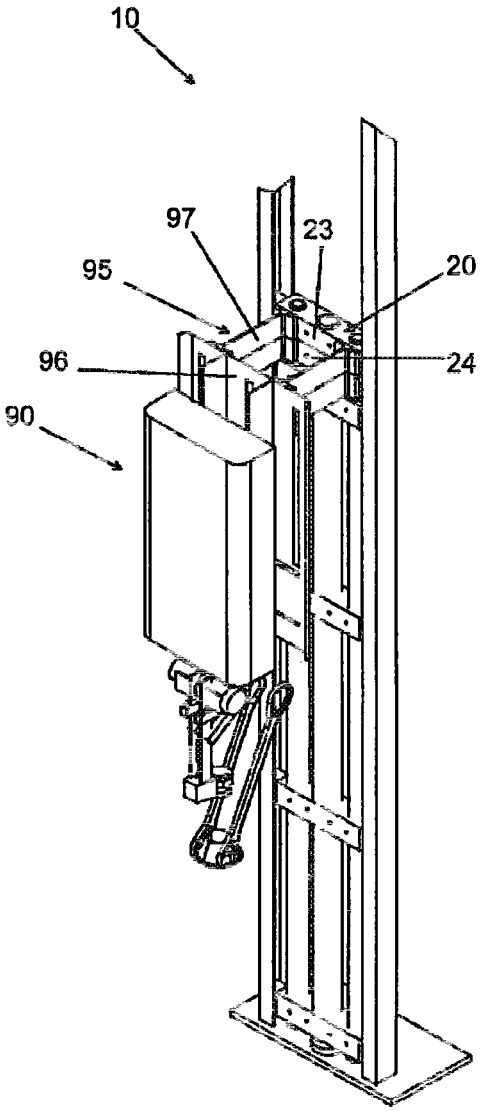
FIG. 6 depicts a close-up isometric view of the lower portion of the hydraulic draw works and the drill head depicted in FIG. 5.

As stated above, the carriage (20) can be adapted for connection with a drill head or other tools to be lifted during drilling or other downhole operations. Referring now to FIGS. 5 and 6, showing an isometric view and a close-up isometric view of an embodiment of the hydraulic draw works (10) in the lowered position. Specifically, the Figures depict a drill head (90) in connection with the carriage (20) by a bracket assembly (95). Although a specific drill head (90) is depicted, the hydraulic draw works (10) can include any other drill head (not shown) known in the art. The bracket (95) can be adapted to receive any drill head (90) sized and selected for the job and temporarily or permanently maintain the drill head (90) in a desired position with respect to the carriage (20). The bracket (95) is shown comprising a plate portion (96) adapted for connection with the drill head (90) and an arm portion (97) adapted for connection with the carriage (20). During operations, the carriage (20) can be subjected to strong bending forces due to the weight of the drill head (90), other tools (not shown), and pipes (not shown) that may be supported by the drill head (90) or other tools.

Furthermore, during drilling operations the drill head (90) will further subject the arms (97) and the carriage (20) to strong counter torque. Accordingly, the arms (97) and the carriage (90) should be designed with the ability to withstand these forces. In the embodiment of the hydraulic draw works (10) depicted in FIGS. 4 and 6, the carriage (20) is shown comprising two elongated blocks (23, 24) wherein each block contains lateral wheels (21, lower set of wheels not shown). The upper (21) and lower wheels are bound within the channel of each guide beam (45, 50) to prevent the carriage (20) from rotating along a horizontal axis due to the weight of the drill head (90) and pipes. Multiple support wheels distribute the forces over a larger area of the guide beams (45, 50), lowering the stresses experienced by the wheels (21), the carriage (20), and the guide beams (45, 50) during operations. In other embodiments (not shown) of the hydraulic draw works (10), the carriage (20) can be vertically longer to allow additional wheels to be incorporated or to provide with a greater distance between the wheels along each guide beam. In yet another embodiment (not shown) of the hydraulic draw works (10), the carriage (20) can comprise lateral members which do not rotate, extending into the channel portion of the vertical guides and function as plain bearings to guide the position and motion.

Figure 7:
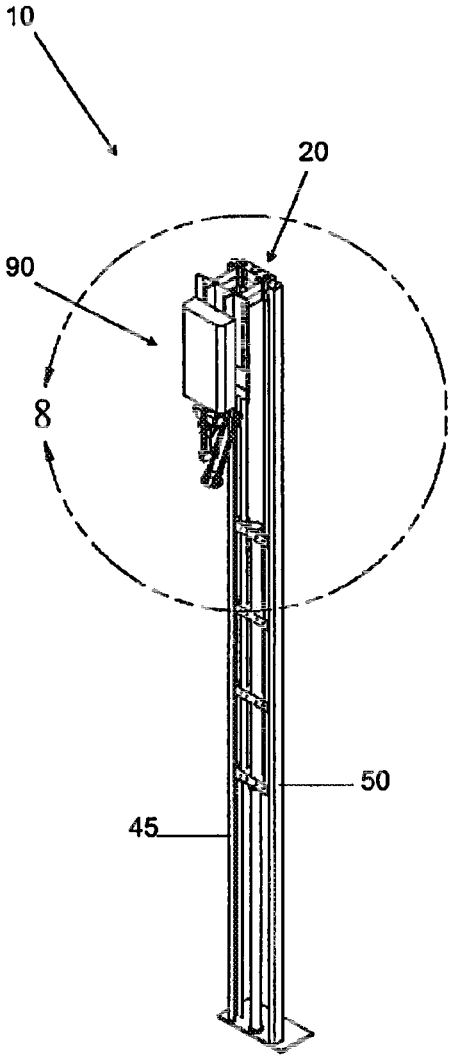
FIG. 7 depicts an isometric view of an embodiment of a hydraulic draw works in accordance with the present disclosure, with the hydraulic cylinders in a fully extended position and the drill head near the top of the guide beams.
Figure 8:
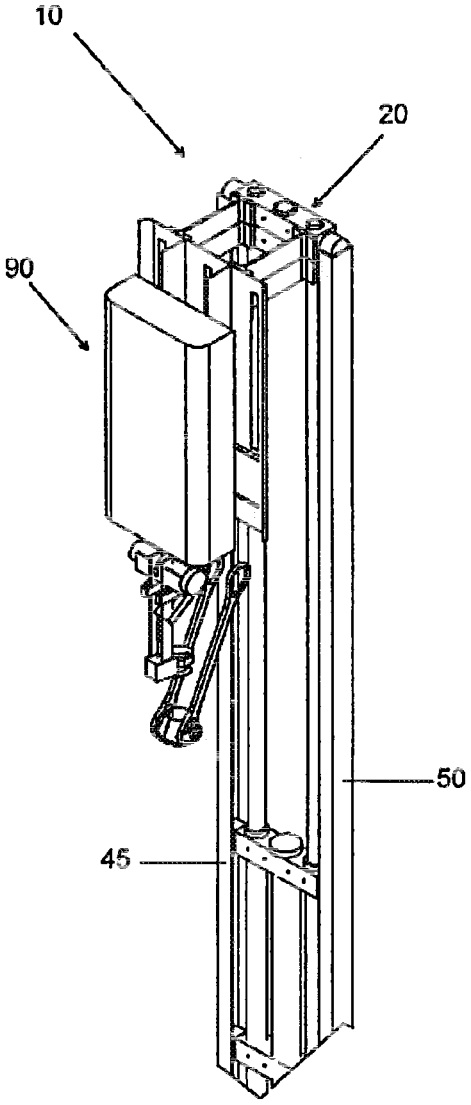
FIG. 8 depicts a close-up isometric view of the upper portion of the hydraulic draw works and the drill head depicted in FIG. 7.

FIGS. 7 and 8 of the present application show an isometric view and a close-up isometric view of an embodiment of the hydraulic draw works (10) in the raised position, wherein the drill head (90) and the carriage (20) are shown positioned near the top of the guide beams (45, 50). Similarly as depicted in FIGS. 6 and 7, the carriage (20) can be adapted for connection with a drill head (90) or other tools to be lifted during drilling or other downhole operations.

In the depicted embodiments of the hydraulic draw works (10), the hydraulic oil feed can be supplied to the central cylinder (60) through the cylinder rod (65), a method known as 'through rod porting'. Utilizing manifold blocks, sequencing valves and/or other hydraulic equipment, pressurized oil can be cross fed into the outer cylinders (70, 80) as required to extend or retract the outer cylinders (70, 80) in accordance with the duty to be performed during operations.

Referring now to FIG. 9, an isometric view of another embodiment of the hydraulic draw works is presented, where the carriage (20) supports a crown wheel assembly (130) comprising a spool (131), a spool mount (133), and a kevlar belt (132) mounted to the spool and connected at one end to the drill head (90) and at the other end to any fixed point on the mast. The crown wheel assembly (130) is positioned on the carriage (20) at the top of the upper cylinders (70, 80) allowing the crown wheel assembly (130) to traverse the vertical plane in accordance with the hydraulic cylinder (60, 70, 80) actuation. This arrangement confers a mechanical advantage in terms of speed and stroke amounting to roughly halve the required hydraulic flow capacity; thus allowing this embodiment to be used in situations where a low maximum installed power is desirable for, e.g., economic or regulatory purposes. While the embodiment is depicted with a kevlar belt (132), it can be appreciated that any attachment device, such as wire ropes, chains, or other appropriate methods, could be employed within the scope of this disclosed embodiment.

Figure 10:
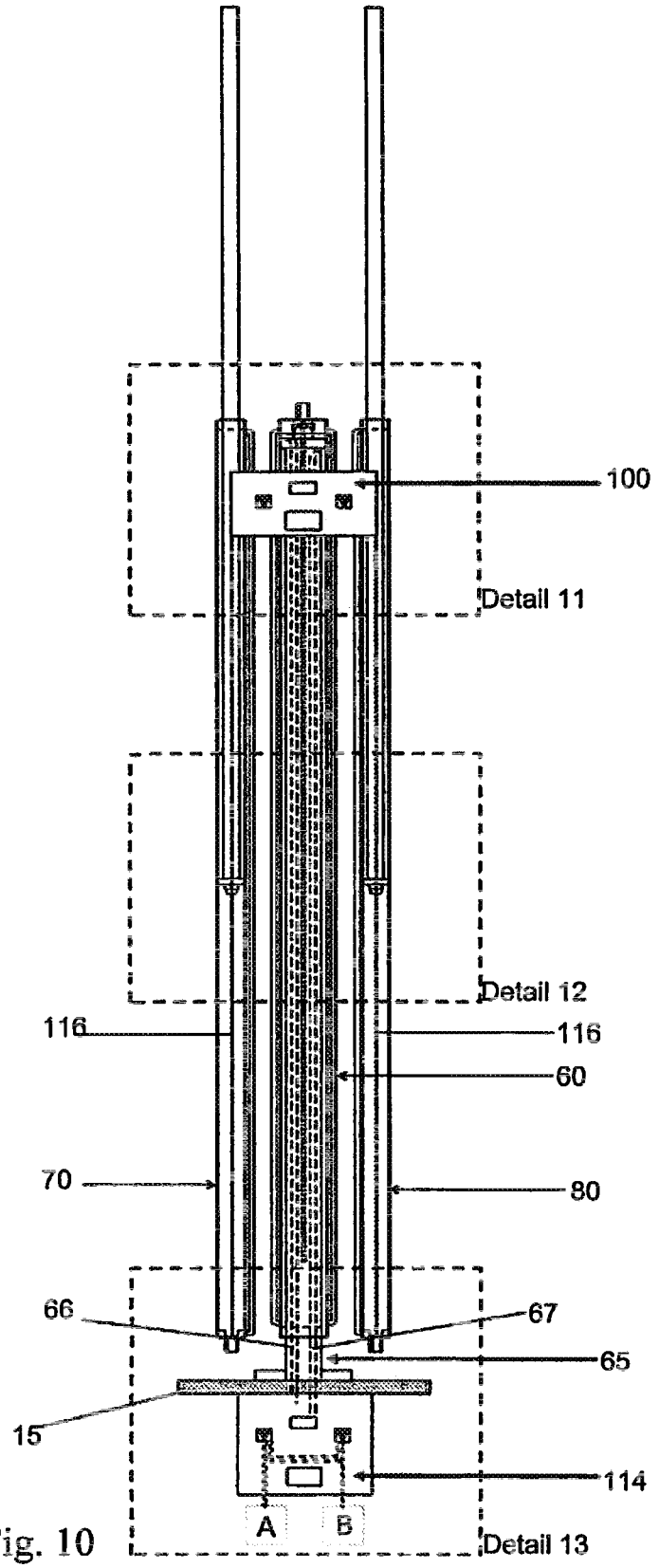
FIG. 10 depicts a cross-sectional view of the hydraulic cylinders of an embodiment of a hydraulic draw works in accordance with the present disclosure.
Figure 14A:
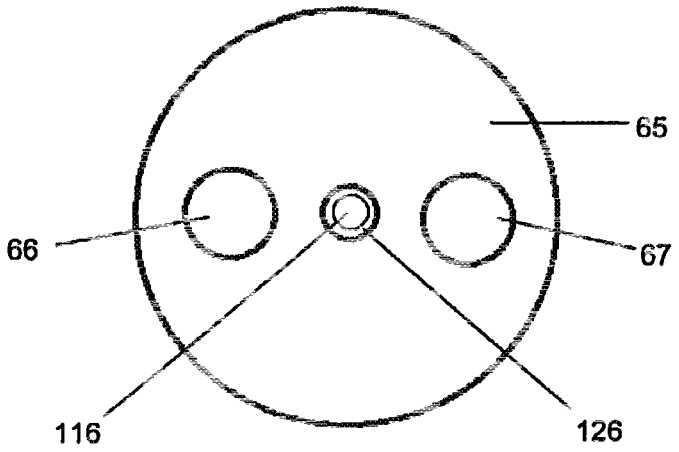
FIG. 14A depicts a cross-sectional view of a central cylinder rod of an embodiment of a hydraulic draw works in accordance with the present disclosure.

Referring now to FIG. 10, a partial cross-sectional view of the hydraulic cylinders (60, 70, 80) of an embodiment of the hydraulic draw works (10) is shown, wherein the outer cylinders (70, 80) are depicted in mid-stroke and the central cylinder (60) is shown retracted for explanation and clarity purposes. Specifically, FIG. 10 depicts the central cylinder (60) with the rod (65) comprising a first rod bore (66) and a second rod bore (67) extending longitudinally therethrough, wherein the rod bores (66, 67) are adapted for communicating pressurized hydraulic fluid or oil therethrough. A cross-sectional view of the rod (65) is shown in FIG. 14A. As further depicted in FIG. 11, the upper end of the first rod bore (66) is aligned with a piston bore (62*a*) extending through the piston (62) of the central cylinder (60), allowing hydraulic fluid to communicate with the full bore area (68) of the cylinder (60), shown above the piston (62). This porting allows the communication of hydraulic fluid into the full bore area (68) to extend the central cylinder (60). The second rod bore (67) is shown extending to a location just short of the piston (62) and ported with (i.e., in fluid communication with) the annular area (69) between the rod (65) and the tubular body (61) below the piston (62). When hydraulic fluid is communicated into the annular area (69), the cylinder can be forced or allowed to retract.

Figure 14B:
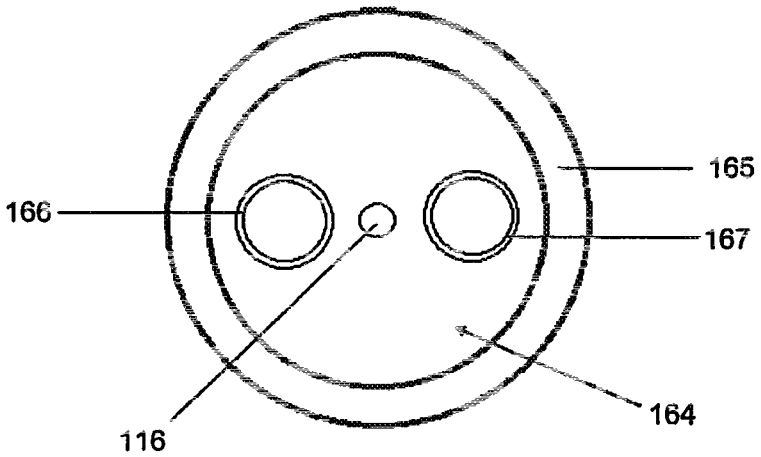
FIG. 14B depicts a cross-sectional view of a central cylinder rod of another embodiment of a hydraulic draw works in accordance with the present disclosure.

As shown in FIG. 14B, another embodiment of the hydraulic draw works (10) can comprise a central cylinder rod (165) having a tubular configuration with a single axial bore (164) extending longitudinally therethrough. The axial bore (164) can accommodate internal conduits (166, 167) positioned therein and extending along the length thereof for communicating hydraulic fluid in a similar fashion as rod bores (66, 67).

Furthermore, the pressurized hydraulic fluid can be cross ported annulus to annulus (i.e., areas in the cylinders between the rod and the tubular body) and full bore to full bore (i.e., areas in the cylinders encompassed by the tubular body opposite side of the piston) across the cylinder arrangement. This is achieved by using a manifold block (100). Referring again to FIG. 11, the manifold block (100) is shown in fluid communication with the full bore area (68) of the central cylinder (60), wherein the hydraulic fluid can flow into or out of the full bore area (68) of the central cylinder (60) through cap end cylinder ports (63*a*) and external conduits (64*a*). As further depicted in FIG. 13, the manifold block (100) can be in fluid communication with the annular area (68) of the central cylinder (60), wherein the hydraulic fluid can flow into or out of the annular area (69) of the central cylinder (60) through rod end cylinder ports (63*b*) and external conduits (64*b*).

Referring again to FIGS. 10, 11, and 13, the manifold block (100) is shown in fluid communication with the annular areas (78, 88) of the outer cylinders (70, 80), wherein the hydraulic fluid can flow into or out of the annular areas (78, 88) through rod end cylinder ports (73*b*, 83*b*) and external conduits (74*b*, 84*b*). As further depicted, the manifold block (100) is shown in fluid communication with the full bore area (78, 88) of the outer cylinders (70, 80), wherein the hydraulic fluid can flow into or out of the full bore areas (78, 88) through cap end cylinder ports (73*a*, 83*a*) and external conduits (74*a*, 84*a*).

Furthermore, pressurized hydraulic fluid can be directionally controlled by digital proportional directional control valves (111, 112, 121, 122). Due to the large flow differential covering the various modes of operation, it may be necessary to utilize two sets of directional control valves. The first directional control valves (111, 121) can allow the maximum flow of hydraulic fluid to pass therethrough, to provide the hydraulic draw works (10) with high speed cylinder (60, 70, 80) extension and retraction during various modes of operation, such as during pipe tripping operations. The second directional control valves (112, 122) can allow a low flow of hydraulic fluid to pass therethrough to provide precise control of the hydraulic draw works (10), such as during drilling operations.

Figure 11:
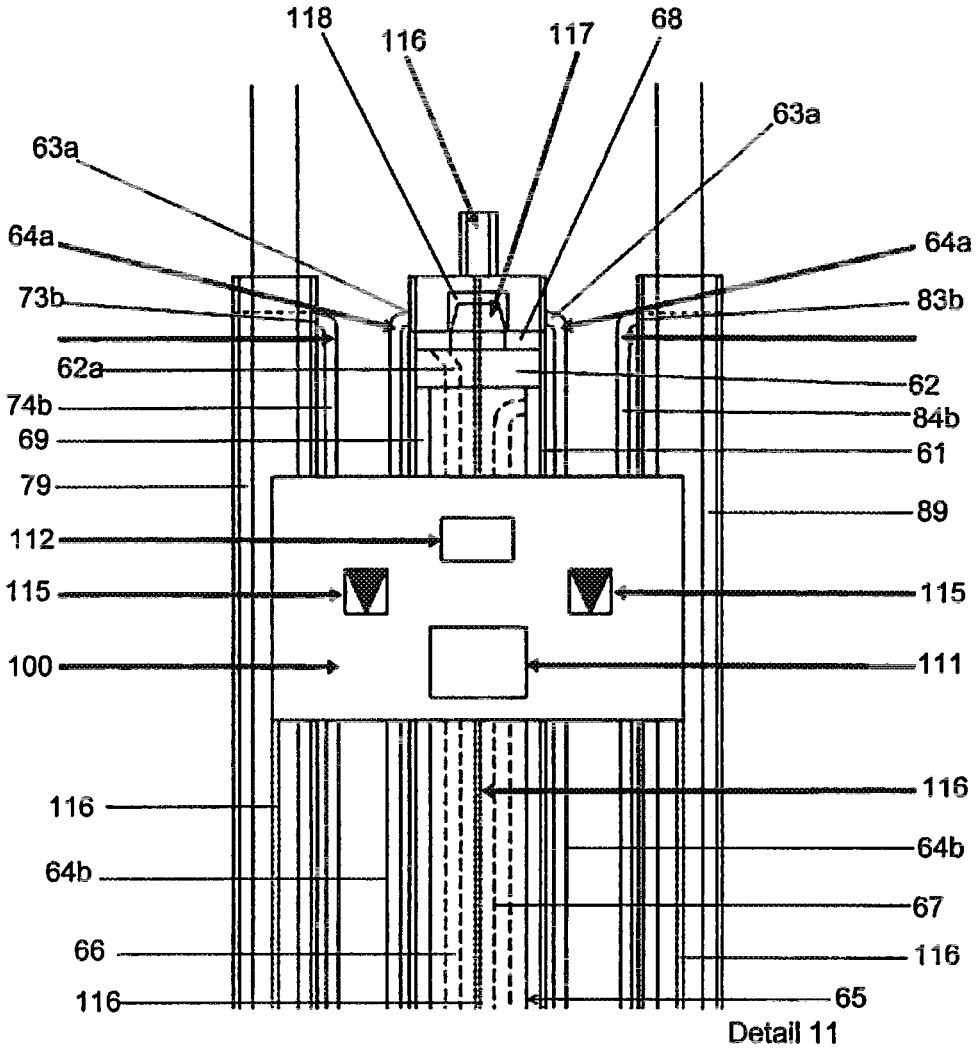
FIG. 11 depicts a cross-sectional close-up view of a top portion of the hydraulic cylinders depicted in FIG. 10.
Figure 13:
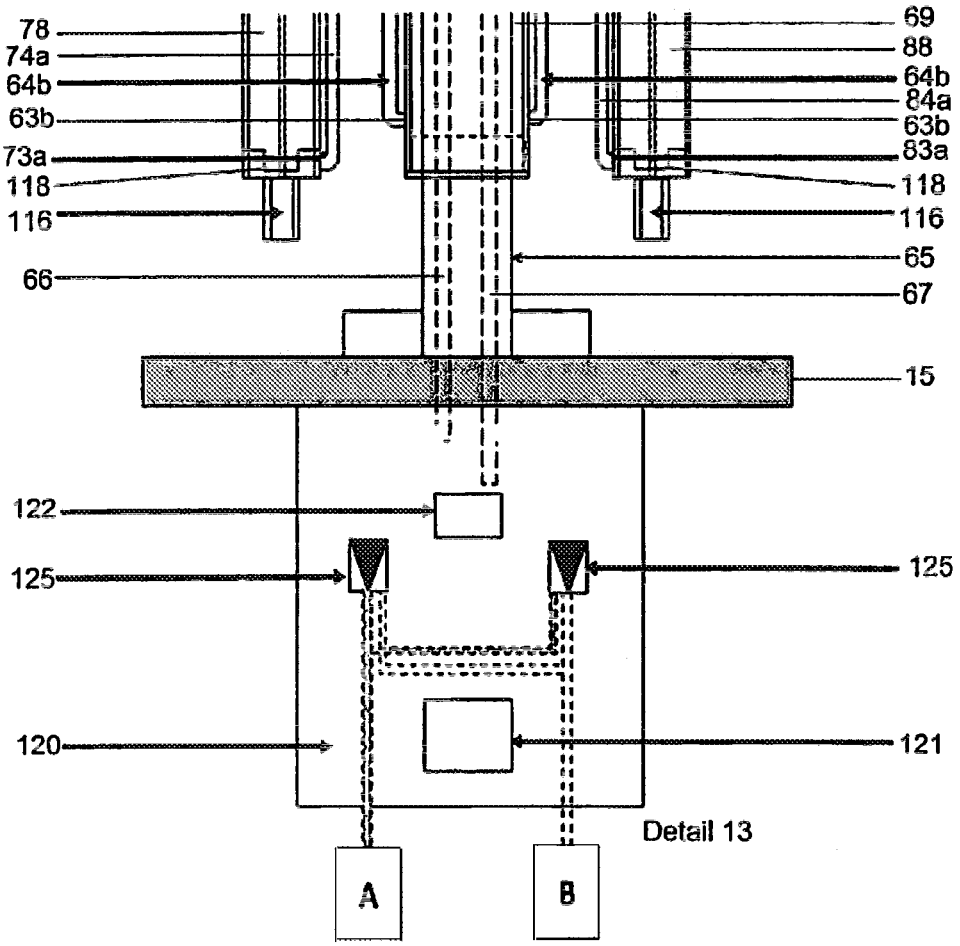
FIG. 13 depicts a cross-sectional close-up view of a lower portion of the hydraulic cylinders depicted in FIG. 10.

Hydraulic load holding check valves, and/or other hydraulic equipment, can be fitted to the hydraulic draw works (10). In the event of a loss of hydraulic pressure (whether via a hose failure or other means) these components will stop the hydraulic draw works (10) from descending under its own weight (and that of attached drilling equipment). FIGS. 11 and 13 further depicts pilot operated load holding check valves (115, 125) included as safety valves to prevent the hydraulic draw works (10) from dropping un-commanded under its own weight. The first set of pilot operated load holding check valves (125) is shown positioned at the base manifold block (120), wherein the check valves (125) communicate the hydraulic fluid flowing into and/or out of the first and second rod bores (66, 67) when the other of the first and second rod bores (66, 67) are pressurized. Upon certain conditions, such as sudden loss of hydraulic fluid pressure at inlet ports A and/or B, the check valves will close, preventing hydraulic fluid from escaping from the rod bores (66, 67). A second set of pilot operated load holding check valves (115) can be positioned at the manifold block (100). Upon certain conditions, such as sudden loss of hydraulic fluid pressure in the manifold block (100), the check valves (115) will close, preventing hydraulic fluid from communicating through conduits (64*a-b*, 74*a-b*, 84*a-b*) to prevent the cylinders (60, 70, 80) from retracting.

As stated above, during hydraulic draw works (10) operations, the directional control valves (111, 112, 121, 122) located on the upper and lower manifolds (100, 120) can alternately control the extension and the retraction actions of the outer hydraulic cylinders (70, 80) and the central hydraulic cylinder (60). Specifically, when actuated or shifted, one of lower directional control valves (121, 122) can allow hydraulic fluid to communicate from pressurized hydraulic fluid source A to rod bore (66) and exhaust from rod bore (67) into tank (B) to raise the central cylinder (60). As the central hydraulic cylinder (60) moves, the directional control valves (111, 112) are closed to prevent hydraulic fluid from escaping into the outer cylinders (70, 80). After the central hydraulic cylinder (60) reaches the top of stroke, one of the directional control valves (11, 112) can be actuated or shifted to allow hydraulic fluid to flow from the full bore area (68) of the central hydraulic cylinder (60), through the conduits (64*a*) into conduits (74*a*, 84*a*) and into full bore areas (78, 88) of the outer hydraulic cylinders (70, 80) to extend the outer hydraulic cylinders (70, 80). Simultaneously, one of the directional control valves (111, 112) allows the hydraulic fluid to flow from the annular areas (79, 89) of the outer hydraulic cylinders (70, 80) through the conduits (74*b*, 84*b*) into conduits (64*b*) and into the annular area (69) of the central hydraulic cylinder (60). The hydraulic fluid then can flow into the second rod bore (67) and exhaust into tank (B).

In order to retract the hydraulic cylinders (60, 70, 80), one of the directional control valves (111, 112) can shift to the opposite position to reverse the direction of fluid flow therethrough, to feed pressurized hydraulic fluid into the annular areas (79, 89) and to allow fluid in the full bore areas (78, 88) to escape into tank (B). Once the outer hydraulic cylinders (70, 80) retract, the valves (111, 112) center to the closed position and one of the directional control valves (121, 122) shifts to the opposite position to reverse the direction of fluid flow therethrough, to feed pressurized hydraulic fluid into the annular area (69) and allow fluid in the full bore area (68) of the central cylinder to escape into tank (B).

In addition, other valves, accumulators, sensors and other hydraulic equipment can be utilized when the hydraulic draw works (10) is required to extend or retract at greater velocities. In an embodiment of the hydraulic draw works (10) depicted in FIGS. 10, 11, and 12, a precise positioning of each hydraulic cylinder (60, 70, 80) can be calculated by using a linear potentiometer (116) extending along the longitudinal axis of the tubular housing (61, 71, 81) of each hydraulic cylinder (60, 70, 80). A magnetic ring (not shown), located in each piston (62, 72, 82), can induce an output signal from each potentiometer (116) as each piston (62, 72, 82), and therefore each magnetic ring, moves about a corresponding potentiometer (116). The output signal generated by the potentiometers (116) can provide a control system (e.g., a PLC or a computer, not shown) with accurate positional data providing the ability to ramp up (accelerate) movement of the cylinders (60, 70, 80), maintain maximum cylinder velocity for an extended period of time, and ramp down (de-accelerate) the movement of the cylinders. The signal output or feedback allows for a smooth transition from movement of the central cylinder (60) to movement of the outer cylinders (70, 80) and reduces and/or removes potential for pressure intensification due to unequal cylinder areas. Referring again to FIG. 14A, the Figure depicts a cross-sectional view of the central cylinder rod (65) having a central bore (126) for accommodating therein the potentiometer (116) as the piston (62, see FIG. 11) moves within the tubular housing (61, see FIG. 11). The control system can be programmed to automatically adjust the hydraulic configuration to achieve optimum performance with the minimum of kW power usage at all times.

Referring again to FIG. 14B, showing a portion of another embodiment of the hydraulic draw works (10), the potentiometer (116) can be positioned within and extend along the length of the single axial bore (164) of the tubular cylinder rod (165).

Inclusion of hydraulic accumulators (not shown) in connection with the manifolds (100, 120) can allow storage of the oil being expelled from the cylinders (60, 70, 80) for faster oil ejection and faster rate of cylinder ascent or decent. During operations, hydraulic fluids can be expelled into the accumulators or other tanks or oil storage containers directly from the manifolds (100, 120) without the need to communicate the hydraulic fluids through conduits, which may restrict the movement of hydraulic fluids to their final destination. Once the cylinders slow down or stop, the hydraulic fluid can be communicated to its final storage destination or container to ensure that the required fluid volume is present when next required in accordance with the drilling operations.

Figure 12:
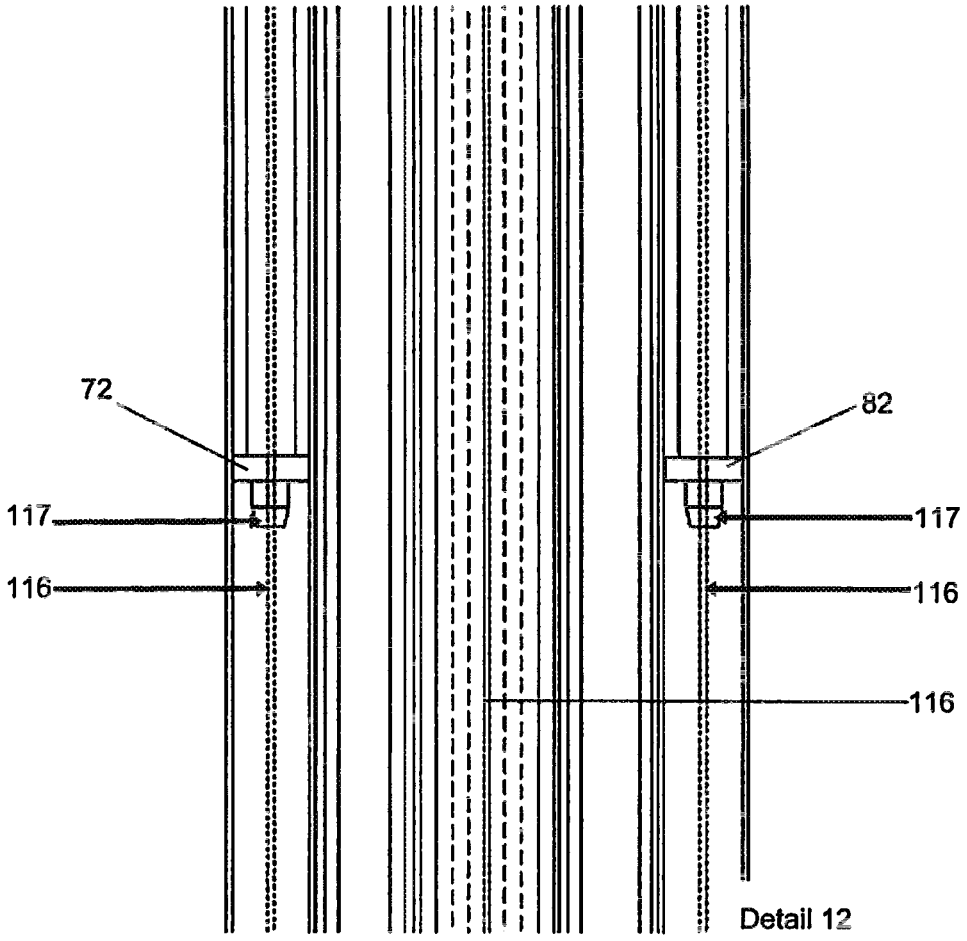
FIG. 12 depicts a cross-sectional close-up view of a central portion of the hydraulic cylinders depicted in FIG. 10.

Additionally each piston (62, 72, 82) within each hydraulic cylinder can be further protected from shock by an inbuilt cushion spear (117), which can be received by a cavity in the corresponding cylinder cap. The cushion spears (117) and the spear cavities are shown in FIGS. 11, 12, and 13.

While various embodiments usable within the scope of the present disclosure have been described with emphasis, it should be understood that within the scope of the appended claims, the present invention can be practiced other than as specifically described herein. It should be understood by persons of ordinary skill in the art that an embodiment of the hydraulic draw works (10) in accordance with the present disclosure can comprise all of the features described above. However, it should also be understood that each feature described above can be incorporated into the hydraulic draw works (10) by itself or in combinations, without departing from the scope of the present disclosure.

What is claimed is:

1. A draw-works for raising and lowering a drill head, the draw-works comprising:

a base;

at least three hydraulic cylinders positioned between a first end and a second end of the draw-works, the at least three hydraulic cylinders each comprising a rod and a piston;

a plurality of braces connecting the at least three hydraulic cylinders;

a carriage mounted to the at least three hydraulic cylinders, and a plurality of guide beams having a receiving portion, wherein the plurality of braces are positioned between the plurality of guide beams so that a portion of each brace of the plurality of braces is located inside the receiving portion of the plurality of guide beams to guide movement of the plurality of braces, and wherein the rod of at least one of the at least three hydraulic cylinders is oriented towards the first end of the draw-works, and the rod of at least another of the at least three hydraulic cylinders is oriented towards the second end of the draw-works, and wherein the drill head is mounted to the carriage.

2. The draw-works of claim 1, wherein the plurality of braces each comprise at least three apertures, and wherein the at least three hydraulic cylinders are positioned through the plurality of braces.

3. The draw-works of claim 1, wherein the carriage is positioned between the plurality of guide beams.

4. The draw-works of claim 3, wherein each brace of the plurality of braces comprises a plurality of guide wheels, wherein each of the plurality of guide wheels is positioned within the receiving portion of the plurality of guide beams to allow the plurality of braces to move vertically.

5. The draw-works of claim 3, wherein the carriage comprises a plurality of guide wheels, wherein each of the plurality of guide wheels is positioned within a respective plurality of guide beams to allow the carriage to move vertically.

6. The draw-works of claim 1, wherein the rod of at least one of the at least three hydraulic cylinders supplies hydraulic fluid through a plurality of conduits adapted for communicating hydraulic fluid therethrough.

7. The draw-works of claim 6, wherein at least one of the at least three hydraulic cylinders is in fluid communication with a remainder of the at least three hydraulic cylinders, and the remainder of the at least three hydraulic cylinders receives hydraulic fluid through the at least one of the at least three hydraulic cylinders.

8. The draw-works of claim 7, wherein a manifold enables fluid communication between the at least three hydraulic cylinders.

9. The draw-works of claim 8, wherein the manifold comprises a first plurality of control valves and a second plurality of control valves, wherein the first plurality of control valves allows a higher flow rate than the second plurality of control valves.

10. The draw-works of claim 8, wherein the manifold comprises a plurality of check valves in communication with the plurality of conduits.

11. The draw-works of claim 1, wherein each of the at least three hydraulic cylinders further comprise a potentiometer for measuring vertical movement of the corresponding rod.

12. The draw-works of claim 11, wherein at least one of the at least three hydraulic cylinders transports at least some hydraulic fluid to a storage tank.

13. The draw-works of claim 1, wherein each of the at least three hydraulic cylinders further comprise a cushion spear.

14. A draw-works, for raising and lowering a drill head, the draw-works comprising:

a base;

at least three hydraulic cylinders positioned between a first end and a second end of the draw-works, the at least three hydraulic cylinders each comprising a rod and a piston;

a plurality of braces connecting the at least three hydraulic cylinders; and a carriage mounted to the at least three hydraulic cylinders, wherein the rod of at least one of the at least three hydraulic cylinders is oriented towards the first end of the draw-works and the rod of at least another of the at least three hydraulic cylinders is oriented towards the second end of the draw-works, wherein the drill head is mounted to the carriage, and wherein the carriage and the drill head are connected through a crown wheel assembly.

15. The draw-works of claim 14, wherein the crown wheel assembly comprises a kevlar belt mounted on a spool, wherein the spool is mounted on the carriage, and wherein the kevlar belt is affixed to the drill head.

16. A method of raising and lowering a drill head mounted on a plurality of hydraulic cylinders, the method comprising:

actuating a first plurality of control valves within a manifold to communicate hydraulic fluid from a pressurized fluid source into at least one central hydraulic cylinder;

actuating a second plurality of control valves within a manifold to prevent fluid communication between the at least one central hydraulic cylinder and at least one outer hydraulic cylinder;

allowing the at least one central hydraulic cylinder to reach a top of stroke;

actuating the second plurality of control valves to allow fluid communication between the at least one central hydraulic cylinder, the at least one outer hydraulic cylinder, and a storage tank;

allowing the at least one outer hydraulic cylinder to reach a top of stroke;

actuating the second plurality of control valves to prevent fluid communication between the pressurized source and the at least one outer hydraulic cylinder;

allowing the at least one outer hydraulic cylinder to retract;

actuating the first plurality of control valves to prevent fluid communication between the pressurized source and the at least one central hydraulic cylinder; and allowing the at least one central hydraulic cylinder to retract.

17. The method of claim 16, further comprising the step of mounting a potentiometer along the plurality of hydraulic cylinders.

18. The method of claim 16, further comprising the step of actuating a third control valve in fluid communication with a hydraulic accumulator to permit fluid communication between the hydraulic accumulator and the pressurized fluid source.

19. The method of claim 18, further comprising the step of actuating the third control valve to permit fluid communication between the hydraulic accumulator and the storage tank.

* * * * *